US011444421B2

(12) United States Patent
Liang et al.

(10) Patent No.: US 11,444,421 B2
(45) Date of Patent: Sep. 13, 2022

(54) AC ADAPTER HAVING FOLDABLE PRONGS

(71) Applicant: Flex Ltd., Singapore (SG)

(72) Inventors: Li-Wei Liang, New Taipei (TW); Yungsung Chen, New Taipei (TW); Jungchih Hsu, New Taipei (TW)

(73) Assignee: Flex Ltd., Singapore (SG)

( * ) Notice: Subject to any disclaimer, the term of this patent is extended or adjusted under 35 U.S.C. 154(b) by 0 days.

(21) Appl. No.: 17/088,270

(22) Filed: Nov. 3, 2020

(65) Prior Publication Data

US 2022/0140553 A1 May 5, 2022

(51) Int. Cl.
*H01R 31/06* (2006.01)
*H01R 13/50* (2006.01)
*H01R 13/44* (2006.01)

(52) U.S. Cl.
CPC ..... *H01R 31/06* (2013.01); *H01R 13/44* (2013.01); *H01R 13/501* (2013.01)

(58) Field of Classification Search
CPC ..... H01R 31/06; H01R 13/44; H01R 13/501
See application file for complete search history.

(56) References Cited

U.S. PATENT DOCUMENTS

| | | | | |
|---|---|---|---|---|
| 7,798,825 | B1 * | 9/2010 | Pai | H01R 31/06 439/131 |
| 10,250,050 | B1 * | 4/2019 | Sumida | H02J 7/0044 |
| 10,283,893 | B2 * | 5/2019 | Wu | H01R 13/631 |
| 10,601,194 | B1 * | 3/2020 | Chien | H01R 24/78 |
| 2009/0227122 | A1 * | 9/2009 | Jubelirer | H01R 31/065 439/11 |
| 2013/0323947 | A1 * | 12/2013 | Lee | H01R 31/06 439/131 |
| 2016/0056600 | A1 * | 2/2016 | Liao | H01R 35/04 439/131 |
| 2019/0207349 | A1 * | 7/2019 | Yuan | H01R 13/631 |
| 2020/0192408 | A1 * | 6/2020 | Chien | G05F 1/45 |
| 2020/0244020 | A1 * | 7/2020 | Sultenfuss | H01R 31/065 |

* cited by examiner

*Primary Examiner* — Truc T Nguyen
(74) *Attorney, Agent, or Firm* — Sheridan Ross P.C.

(57) ABSTRACT

A power adapter is disclosed with retractable prongs to engage an outlet and obtain power therefrom, when extended, and be partially or entirely within the housing of the power adapter when retracted. To ensure safe operation, a channel is provided within the power adapter to accommodate the prongs when retracted and to accommodate the prongs travel as they pivot between extended and retracted. The channel is width-limited and/or has a length to make it impossible or, at least, exceptionally difficult for a human finger to come into contact with the prongs while the prongs are extended and sufficiently engaged with an outlet to obtain power therefrom.

17 Claims, 5 Drawing Sheets

AC ADAPTER HAVING FOLDABLE PRONGS

COPYRIGHT NOTICE

A portion of the disclosure of this patent document contains material that is subject to copyright protection. The copyright owner has not objected to the facsimile reproduction by anyone of the patent document or the patent disclosure as it appears in the Patent and Trademark Office patent files or records, but otherwise reserves all copyright rights whatsoever.

FIELD OF THE DISCLOSURE

The invention relates generally to systems and methods for power adapters and particularly to compact and foldable AC adapter.

BACKGROUND

Many electrical devices are manufactured to run on a factory-determined voltage and/or direct current while the source current is often alternating current. Accordingly, an electrical adapter is often necessary to provide a physical connection between to the AC outlet and the DC device, as well as to convert the AC current into DC and provide any necessary changes in voltage.

SUMMARY

These and other needs are addressed by the various embodiments and configurations of the present invention. The present invention can provide a number of advantages depending on the particular configuration. These and other advantages will be apparent from the disclosure of the invention(s) contained herein.

In one embodiment, an electrical adapter (or, more simply, "adapter") is disclosed comprising foldable prongs to enable the electrical adapter to engage an outlet and obtain electrical power therefrom, when the prongs are extended, and fold away to be entirely or partially within the interior of the adapter when the prongs are retracted.

The adapter may have a removable or fixed connection to an electronic device, such as to provide DC current and/or a voltage different from that provided by the outlet to a device. The external device receives power from the DC pins or other connection portions of the adapter via a power cord. In another embodiment, the adapter itself is the electronic device that consumes the power, such as when the electronic device is embodied as battery charger, light, security camera, radio frequency device (e.g., WiFi repeater/router, AM-FM radio, etc.), or other device.

In one embodiment, the adapter comprises prongs to engage an electrical outlet to obtain electrical power therefrom. In a further embodiment, the adapter and prongs are configured to engage a National Electrical Manufactures Association (NEMA) Type A or Type B outlet, specifically a hot and neutral connection. For Type B outlets the grounding connection is unused by the adapter and is absent a prong to engage the grounded connector. In another embodiment, the prongs and adapter may be configured to engage other types of outlets wherein the prongs are linearly aligned, such as Type C, Type E, Type F other types of outlets wherein the outlet may comprise a non-linearly aligned connection that is unused by the adapter, such as Type D, Type G, etc. where the hot and neutral are linearly aligned and no grounding prong is provided.

Exemplary Aspects are Directed to:

A power adapter, comprising:

prongs comprising a first set of electrical connectors pivotably attached to the power adapter;

a second set of electrical connectors configured to engage a device and provide electrical power thereto; and wherein the prongs may be pivoted to a retracted position thereby placing the prong substantially within the power adapter; and wherein the prongs may be pivoted to an extended position thereby placing the prongs substantially perpendicular to a facet of the power adapter and thereby place the power adapter into a configuration wherein the prongs are extended to engage a power outlet and obtain electrical power therefrom.

An electronic device, comprising:

prongs comprising a set of electrical connectors pivotably attached to the electronic device;

wherein the prongs may be pivoted to a retracted position thereby placing the prong substantially within the electronic device; and wherein the prongs may be pivoted to an extended position thereby placing the prongs substantially perpendicular to a facet of the electronic device and thereby place the electronic device into a configuration wherein the prongs are extended to engage a power outlet and obtain electrical power therefrom.

A power conversion device, comprising:

a prong base, comprising prongs, wherein the prongs comprise a set of electrical connectors and the prong base being pivotably attached to the power conversion device;

a channel in the facet of the power conversion device;

a second set of electrical connectors configured to engage a device and provide electrical power thereto; and wherein the prongs may be pivoted to a retracted position thereby placing the prong substantially within the power conversion device; and wherein the prongs may be pivoted to an extended position thereby placing the prongs substantially perpendicular to a facet of the power conversion device and thereby place the power conversion device into a configuration wherein the prongs are extended to engage a power outlet and obtain electrical power therefrom;

wherein the channel comprises a first portion to narrowly accommodate the first set of electrical connectors, having a first width, when the prongs are in the retracted position or to enable transitioning the prongs to or from the retracted position and wherein the first portion of the channel is sufficiently narrow to prevent a human finger from reaching one of the set of electrical connectors when the prongs are extended and sufficiently engaged with the power outlet to obtain power therefrom; and wherein the channel comprises a second portion to narrowly accommodate the prong base having a second width wider than the first width.

Any of the Above Aspects:

Wherein the prongs via attachment to the prong base are pivotably attached to the power adapter; a channel in the facet of the power adapter; wherein the channel comprises a first portion to narrowly accommodate the first set of electrical connectors, having a first width, when the prongs are in the retracted position or to enable transitioning the prongs to or from the retracted position; and wherein the channel comprises a second portion to narrowly accommodate the prong base having a second width wider than the first width.

Wherein the first portion of the channel is substantially 6.6 millimeters.

Wherein the first portion of the channel is sufficiently narrow to prevent a human finger from reaching one of the first set of electrical connectors when the prongs are extended and sufficiently engaged with the power outlet to obtain power therefrom.

Wherein the second portion of the channel is substantially 9 millimeters.

Further comprising, power conversion circuitry to cause alternating current received by the prongs when engaged with the power outlet, to be provided as direct current to the second set of electrical connectors.

Further comprising, power conversion circuitry to cause a first voltage received by the prongs when engaged with the power outlet, to be provided as a second voltage to the second set of electrical connectors.

Further comprising: a spring applying a force to the prongs when in a first position comprising one of the retracted position or the extended position; and a latch to selectively retain the prongs in the first position and, when released, allow the spring to apply the force to the prongs to cause the prongs to move in to a second position comprising the other of the retracted position or the extended position.

Wherein the second set of electrical connectors configured to engage the device and provide electrical power thereto, comprise a removable socket to engage a power cord attachable to the device.

Wherein the second set of electrical connectors configured to engage the device and provide electrical power thereto, comprise contact pads within the power adapter to accommodate a rechargeable battery for charging.

Further comprising: a prong base, wherein the prongs via attachment to the prong base, are pivotably attached to the electronic device; a channel in the facet of the electronic device; wherein the channel comprises a first portion to narrowly accommodate the set of electrical connectors, having a first width, when the prongs are in the retracted position or to enable transitioning the prongs to or from the retracted position; and wherein the channel comprises a second portion to narrowly accommodate the prong base having a second width wider than the first width.

Wherein the first portion of the channel is substantially 6.6 millimeters.

Wherein the first portion of the channel is sufficiently narrow to prevent a human finger from reaching one of the set of electrical connectors when the prongs are extended and sufficiently engaged with the power outlet to obtain power therefrom.

Wherein the second portion of the channel is substantially 9 millimeters.

Further comprising, power conversion circuitry to cause alternating current received by the prongs when engaged with the power outlet, to be provided to the electronic device as direct current.

Further comprising, power conversion circuitry to cause a first voltage received by the prongs when engaged with the power outlet, to be provided as a second voltage to the electronic device.

Further comprising: a spring applying a force to the prongs when in a first position comprising one of the retracted position or the extended position; and a latch to selectively retain the prongs in the first position or, when released, allow the spring to apply the force to the prongs to cause the prongs in to move to a second position comprising the other of the retracted position or the extended position.

Wherein the electronic device comprises a second set of electrical connectors configured to engage a power cord attachable to another device to apply power thereto.

A system on a chip (SoC) including any one or more of the above aspects.

One or more means for performing any one or more of the above aspects.

Any one or more of the aspects as substantially described herein.

Any of the above aspects, wherein the data storage comprises a non-transitory storage device comprise at least one of: an on-chip memory within the processor, a register of the processor, an on-board memory co-located on a processing board with the processor, a memory accessible to the processor via a bus, a magnetic media, an optical media, a solid-state media, an input-output buffer, a memory of an input-output component in communication with the processor, a network communication buffer, and a networked component in communication with the processor via a network interface.

The phrases "at least one," "one or more," "or," and "and/or" are open-ended expressions that are both conjunctive and disjunctive in operation. For example, each of the expressions "at least one of A, B, and C," "at least one of A, B, or C," "one or more of A, B, and C," "one or more of A, B, or C," "A, B, and/or C," and "A, B, or C" means A alone, B alone, C alone, A and B together, A and C together, B and C together, or A, B, and C together.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

The term "automatic" and variations thereof, as used herein, refers to any process or operation, which is typically continuous or semi-continuous, done without material human input when the process or operation is performed. However, a process or operation can be automatic, even though performance of the process or operation uses material or immaterial human input, if the input is received before performance of the process or operation. Human input is deemed to be material if such input influences how the process or operation will be performed. Human input that consents to the performance of the process or operation is not deemed to be "material."

Aspects of the present disclosure may take the form of an embodiment that is entirely hardware, an embodiment that is entirely software (including firmware, resident software, micro-code, etc.) or an embodiment combining software and hardware aspects that may all generally be referred to herein as a "circuit," "module," or "system." Any combination of one or more computer-readable medium(s) may be utilized. The computer-readable medium may be a computer-readable signal medium or a computer-readable storage medium.

A computer-readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer-readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer-readable storage medium may be any tangible, non-transitory medium that can contain or store a program for use by or in connection with an instruction execution system, apparatus, or device.

A computer-readable signal medium may include a propagated data signal with computer-readable program code embodied therein, for example, in baseband or as part of a carrier wave. Such a propagated signal may take any of a variety of forms, including, but not limited to, electromagnetic, optical, or any suitable combination thereof. A computer-readable signal medium may be any computer-readable medium that is not a computer-readable storage medium and that can communicate, propagate, or transport a program for use by or in connection with an instruction execution system, apparatus, or device. Program code embodied on a computer-readable medium may be transmitted using any appropriate medium, including, but not limited to, wireless, wireline, optical fiber cable, RF, etc., or any suitable combination of the foregoing.

The terms "determine," "calculate," "compute," and variations thereof, as used herein, are used interchangeably and include any type of methodology, process, mathematical operation or technique.

The term "means" as used herein shall be given its broadest possible interpretation in accordance with 35 U.S.C., Section 112(f) and/or Section 112, Paragraph 6. Accordingly, a claim incorporating the term "means" shall cover all structures, materials, or acts set forth herein, and all of the equivalents thereof. Further, the structures, materials or acts and the equivalents thereof shall include all those described in the summary, brief description of the drawings, detailed description, abstract, and claims themselves.

The preceding is a simplified summary of the invention to provide an understanding of some aspects of the invention. This summary is neither an extensive nor exhaustive overview of the invention and its various embodiments. It is intended neither to identify key or critical elements of the invention nor to delineate the scope of the invention but to present selected concepts of the invention in a simplified form as an introduction to the more detailed description presented below. As will be appreciated, other embodiments of the invention are possible utilizing, alone or in combination, one or more of the features set forth above or described in detail below. Also, while the disclosure is presented in terms of exemplary embodiments, it should be appreciated that an individual aspect of the disclosure can be separately claimed.

BRIEF DESCRIPTION OF THE DRAWINGS

The present disclosure is described in conjunction with the appended figures.

DETAILED DESCRIPTION

The ensuing description provides embodiments only and is not intended to limit the scope, applicability, or configuration of the claims. Rather, the ensuing description will provide those skilled in the art with an enabling description for implementing the embodiments. It will be understood that various changes may be made in the function and arrangement of elements without departing from the spirit and scope of the appended claims.

Any reference in the description comprising a numeric reference number, without an alphabetic sub-reference identifier when a sub-reference identifier exists in the figures, when used in the plural, is a reference to any two or more elements with a like reference number. When such a reference is made in the singular form, but without identification of the sub-reference identifier, is a reference one of the like numbered elements, but without limitation as to the particular one of the elements. Any explicit usage herein to the contrary or providing further qualification or identification shall take precedence.

The exemplary systems and methods of this disclosure will also be described in relation to analysis software, modules, and associated analysis hardware. However, to avoid unnecessarily obscuring the present disclosure, the following description omits well-known structures, components, and devices, which may be omitted from or shown in a simplified form in the figures or otherwise summarized.

For purposes of explanation, numerous details are set forth in order to provide a thorough understanding of the present disclosure. It should be appreciated, however, that the present disclosure may be practiced in a variety of ways beyond the specific details set forth herein.

Figure 1:
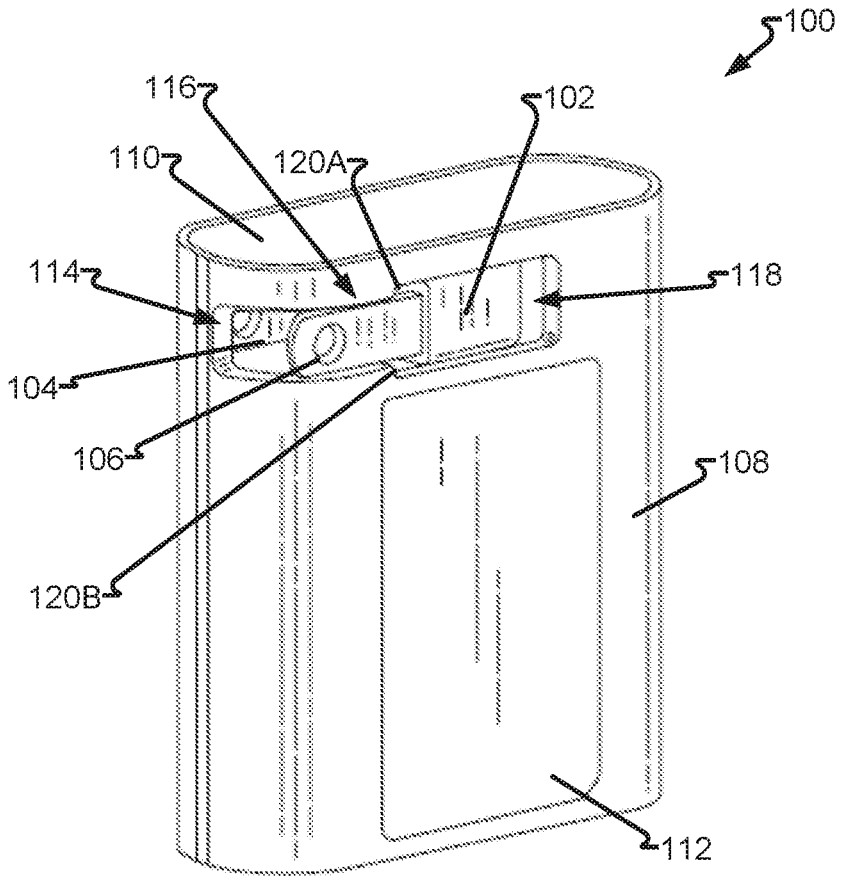
FIG. 1 depicts an adapter in accordance with embodiments of the present disclosure.

FIG. 1 depicts adapter 100 in accordance with embodiments of the present disclosure. In one embodiment, adapter 100 comprises prong base 102 further comprising conductive prong 104 and conductive prong 106 to rotationally pivot between a retracted position (as illustrated) and an extended position. Adapter 100 comprises top cap 110 and channel 114 to accommodate prong base 102 and conductive prong 104 and conductive prong 106 entirely or partially within the interior of adapter 100 when retracted.

Like all devices that can or could connect to household current (e.g., 120*v* AC in the US), making contact with a conductor with, for example, a finger may result in serious harm. Accordingly, channel 114 comprises first portion 116 and second portion 118 delineated by shoulder 120, comprised by shoulder 120A and shoulder 120B. As a result second portion 118 is wider than channel 114 but limited to narrowly accommodate prong base 102 in the retracted position as well as to enable prong base 102 to transition to and from the retracted position. First portion 116 narrowly accommodates conductive prong 104 and conductive prong 106 but with insufficient space to allow a human finger to reach, or come within a previously determined limit from, conductive prong 104 while prong base 102 is extended and sufficiently engaged with an outlet or extension cord to make electrical contact with the conductors of the outlet or extension cord.

Adapter 100 may comprise nearly any form factor including, but not limited to, the form factor illustrated in FIG. 1. When prong base 102 is extended, prong base 102 is substantially perpendicular to adapter facet 108 and within the centerline, or center of mass, of adapter 100 so as to avoid applying a torque to a wall outlet when engaged therewith. For example, a downward force, such as by a user stepping on an adapter cord attached to the bottom of adapter 100 (see FIG. 7) will apply a substantially even and downward force on conductive prong 104 and conductive prong 106 and the outlet with substantially no torque which would more likely result in damage to adapter 100 and/or the outlet.

Adapter 100 may comprise indent area 112, such as to accommodate a label, logo, or other markings. Alternatively, indent area 112 may be an outdent having a height limited so as to not impede conductive prong 104 and conductive prong 106 from engaging the electrical connectors of an outlet.

Figure 2:
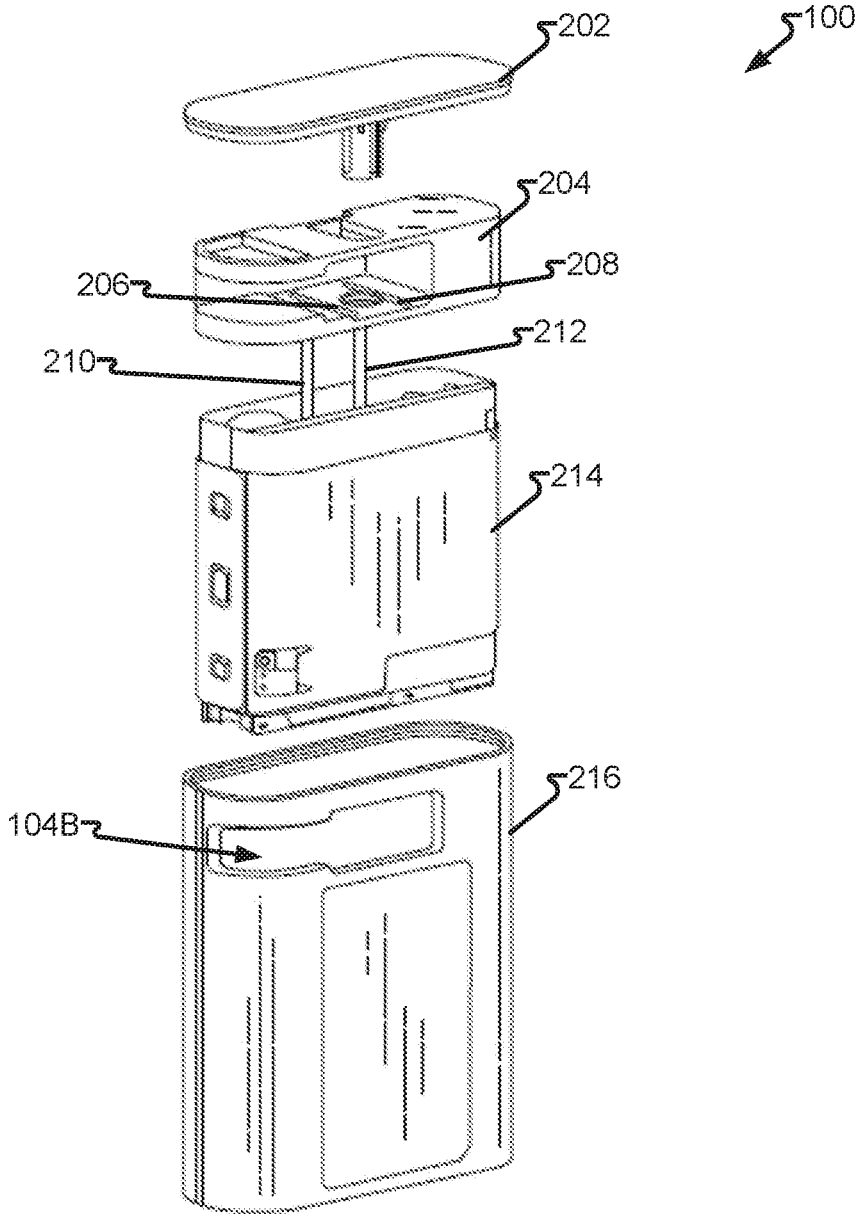
FIG. 2 depicts an exploded view of the adapter in accordance with embodiments of the present disclosure.

FIG. 2 depicts an exploded view of adapter 100 in accordance with embodiments of the present disclosure. In one embodiment, adapter 100 comprise a number of assembled components. For example, housing 216 houses other components of adapter 100 such as printed circuit board assembly 214, which in turn comprises electronics, such as a rectifier or other circuitry to convert AC current to DC and/or change voltages. Additionally or alternatively, adapter 100 may comprise an electronic device, such as a battery charger, wherein printed circuit board assembly comprises contact pads to charge one or more batteries placed within an opening (not shown) in housing 216.

Printed circuit board assembly 214 receives power from pins 210 and 212 which in term are connected to pins 206 and 208, which intern are connected to prong base 102 and ones of conductive prong 104 and conductive prong 106 (omitted from FIG. 2 for clarity) to engage an outlet and receive power therefrom. Cap 202 engages holder 204 to close the top portion of adapter 100.

Figure 3:
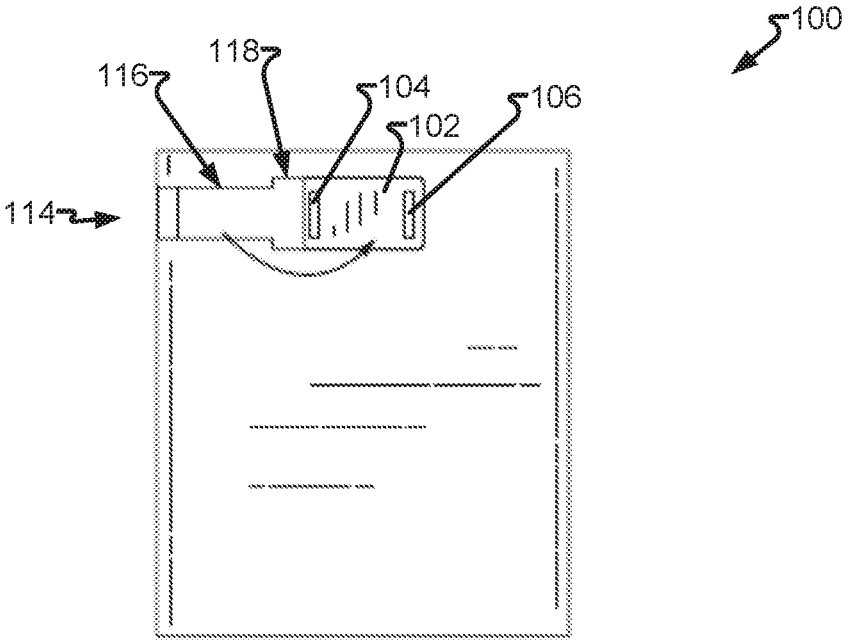
FIG. 3 depicts a first front view of the adapter in accordance with embodiments of the present disclosure.

FIG. 3 depicts a first front view of adapter 100 in accordance with embodiments of the present disclosure. Prong base 102 is extended, such as to enable engagement with an outlet (e.g., wall outlet, extension cord, power strip, etc.) to apply electrical power to conductive prong 104 and conductive prong 106. It should be appreciated that one of conductive prong 104 and conductive prong 106 may be "hot" and the other of conductive prong 104 and conductive prong 106 may be a neutral. As a further option, each of conductive prong 104 and conductive prong 106 may be a hot when utilized with in two-phase power supply systems.

Prong base 102, is pivotably attached to adapter 100, such as to holder 204 (see FIG. 2) and extended therefrom. Channel 114 comprises first portion 116 and second portion 118. Second portion 118 accommodates prong base 102 whereas first portion 116 accommodates conductive prong 104 and/or conductive prong 106. First portion 116 is narrower than second portion 118, in part, to reduce the width of first portion 116 to only that which is necessary (plus or minus necessary tolerances, preferably less than one millimeter) and generally leaves a pathway to conductive prong 104 that is too narrow and prevents a human finger from reaching or coming unacceptably close to conductive prong 104 while top cap 110 is sufficiently engaged with an outlet such that conductive prong 104 and conductive prong 106 are electrically energized from the contacts of the outlet.

Figure 4:
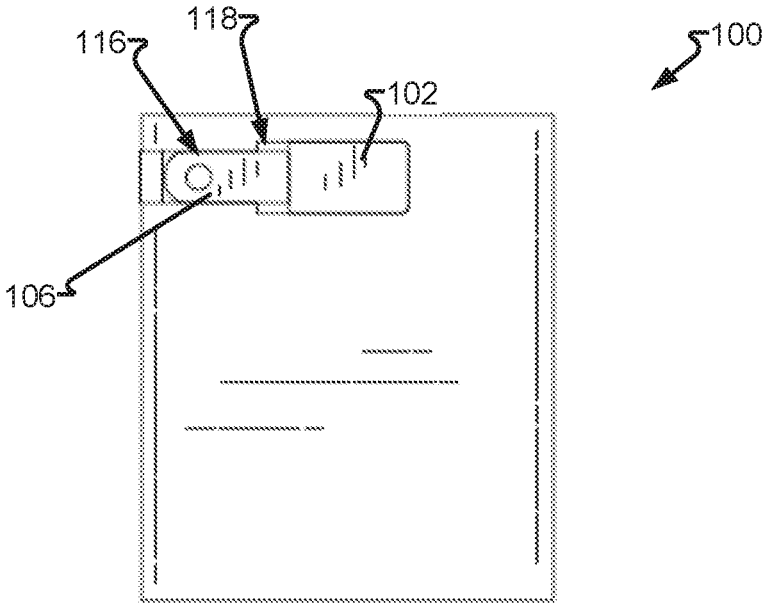
FIG. 4 depicts a second front view of the adapter in accordance with embodiments of the present disclosure.

FIG. 4 depicts a second front view of adapter 100 in accordance with embodiments of the present disclosure. Prong base 102 is retracted and conductive prong 104 (not shown) and conductive prong 106 are narrowly accommodated by first portion 116 whereas second portion 118 narrowly accommodates prong base 102. It should be appreciated that second portion 118 has a size that is at least big enough to accommodate prong base 102 and prong base 102 when pivoted to and from the retracted position.

Figure 5:
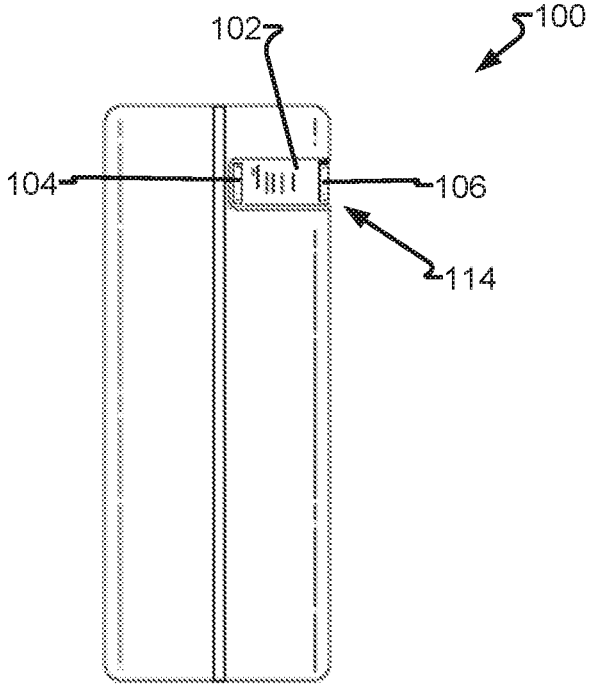
FIG. 5 depicts a first side view of the adapter in accordance with embodiments of the present disclosure.

FIG. 5 depicts a first side view of adapter 100 in accordance with embodiments of the present disclosure. Prong base 102 comprises conductive prong 104 and conductive prong 106 in channel 114 when in a retracted configuration.

Figure 6:
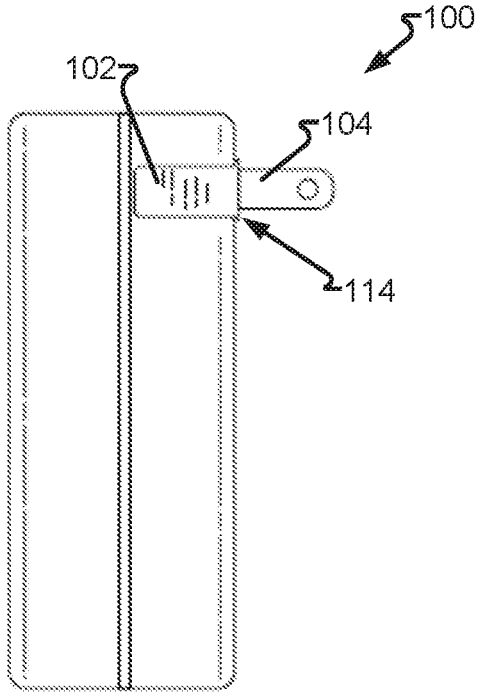
FIG. 6 depicts a second side view of the adapter in accordance with embodiments of the present disclosure.

FIG. 6 depicts a second side view of adapter 100 in accordance with embodiments of the present disclosure. Prong base 102 is in the extended configuration exposing conductive prong 106 (not visible) and conductive prong 104 to engage the connections of an outlet.

Figure 7:
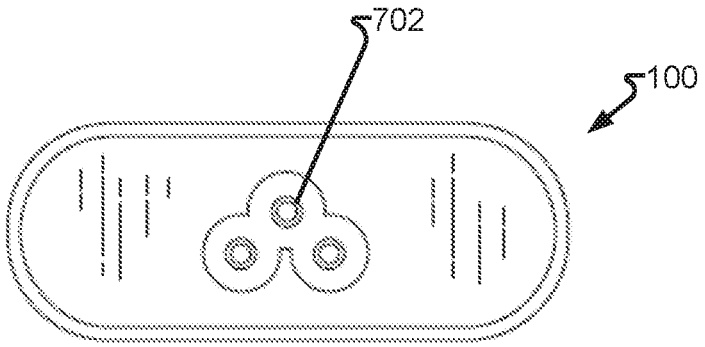
FIG. 7 depicts a bottom view of the adapter in accordance with embodiments of the present disclosure.

FIG. 7 depicts a bottom view of adapter 100 in accordance with embodiments of the present disclosure. In one embodiment, adapter 100 comprises detachable connection 702 such as to engage an electronic device directly or via a cord to supply power thereto.

Figure 8:
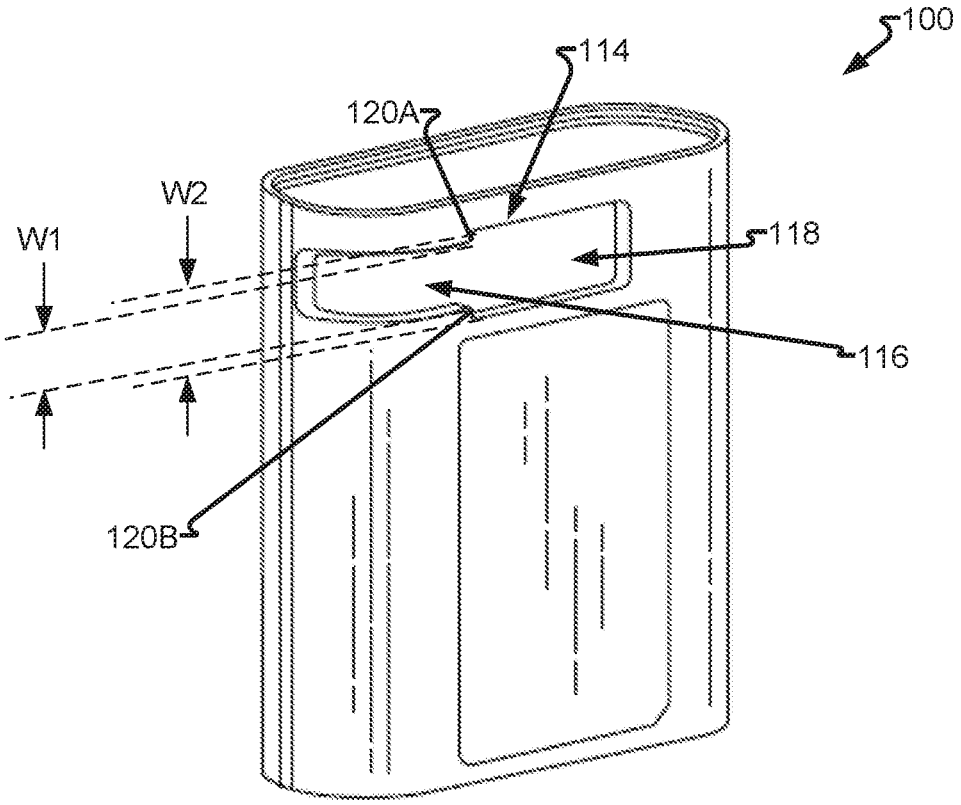
FIG. 8 depicts the adapter with channel details in accordance with embodiments of the present disclosure.

FIG. 8 depicts adapter 100 with channel 114 details in accordance with embodiments of the present disclosure. Adapter 100, in comprises channel 114 in housing 216 and/or holder 204 (see FIG. 2). Channel 114 comprises first portion 116 and second portion 118 being delineated by shoulder 120A and/or shoulder 120B to narrowly accommodate prong base 102, and the pivoting travel thereof, in second portion 118 and accommodate conductive prong 104 and/or conductive prong 106, and the pivoting travel thereof, in channel 114. The width (W1) of first portion 116 being sufficient to accommodate conductive prong 104 and/or conductive prong 106 with sufficient tolerance that may be expected to be needed for operation over time. In one embodiment, W1 is 6.6 mm. In another embodiment, W1 is 6.6 mm within a previously determined tolerance, such as 1 mm. Accordingly, when adapter 100 is sufficiently engaged with an outlet to receive electrical power therefrom channel 114 is sized to not accommodate a human finger making contact with conductive prong 104. Preferable channel 114 does not allow a human finger to get closer than about 7 mm to conductive prong 104. Additionally conductive prong 104, when prong base 102 is extended is preferable a distance of 20.3 mm or more from the edge of adapter 100, thereby requiring a human finger to travel within channel 114 20.3 mm or more within the W1 of first portion 116 before making contact with conductive prong 104 while sufficiently engaged with an outlet to obtain power therefrom. Width (W2) of second portion 118 accommodates prong base 102 and may be 9 mm, plus or minus required tolerances to ensure usage over time. Should a finger be inserted into channel 114 the width of the finger would separate adapter 100 from the outlet and disconnect conductive prong 104 and/or conductive prong 106 from the connectors of the outlet before the finger made contact with conductive prong 104.

As a further option, prong base 102 may be spring loaded (not shown) and held in place by a latch (not shown) so that the latch, when released allows the spring to transition prong base 102 from one of extended and retracted to the other of extended and retracted.

Although the present invention describes components and functions implemented in the embodiments with reference to particular standards and protocols, the invention is not limited to such standards and protocols. Other similar standards and protocols not mentioned herein are in existence and are considered to be included in the present invention. Moreover, the standards and protocols mentioned herein, and other similar standards and protocols not mentioned herein are periodically superseded by faster or more effective equivalents having essentially the same functions. Such replacement standards and protocols having the same functions are considered equivalents included in the present invention.

The present invention, in various embodiments, configurations, and aspects, includes components, methods, processes, systems and/or apparatus substantially as depicted and described herein, including various embodiments, subcombinations, and subsets thereof. Those of skill in the art will understand how to make and use the present invention after understanding the present disclosure. The present invention, in various embodiments, configurations, and aspects, includes providing devices and processes in the absence of items not depicted and/or described herein or in various embodiments, configurations, or aspects hereof, including in the absence of such items as may have been used in previous devices or processes, e.g., for improving performance, achieving ease, and\or reducing cost of implementation.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments, configurations, or aspects for the purpose of streamlining the disclosure. The features of the embodiments, configurations, or aspects of the invention may be combined in alternate embodiments, configurations, or aspects other than those discussed above. This method of disclosure is not to be interpreted as reflecting an intention that the claimed invention requires more features than are expressly recited in each claim. Rather, as the following claims reflect, inventive aspects lie in less than all features of a single foregoing disclosed embodiment, configuration, or aspect. Thus, the following claims are hereby incorporated into this Detailed Description, with each claim standing on its own as a separate preferred embodiment of the invention.

Moreover, though the description of the invention has included description of one or more embodiments, configurations, or aspects and certain variations and modifications, other variations, combinations, and modifications are within the scope of the invention, e.g., as may be within the skill and knowledge of those in the art, after understanding the present disclosure. It is intended to obtain rights, which include alternative embodiments, configurations, or aspects to the extent permitted, including alternate, interchangeable and/or equivalent structures, functions, ranges, or steps to those claimed, whether or not such alternate, interchangeable and/or equivalent structures, functions, ranges, or steps are disclosed herein, and without intending to publicly dedicate any patentable subject matter.

What is claimed is:

1. A power adapter, comprising:

a channel in a facet of the power adapter;

prongs comprising a first set of electrical connectors pivotably attached to the power adapter; and a second set of electrical connectors configured to engage a device and provide electrical power thereto; and wherein the prongs may be pivoted to a retracted position thereby placing the prong substantially within the power adapter; and wherein the prongs may be pivoted to an extended position thereby placing the prongs substantially perpendicular to a facet of the power adapter and thereby place the power adapter into a configuration wherein the prongs are extended to engage a power outlet and obtain electrical power therefrom; and wherein the channel comprises a first portion to narrowly accommodate the first set of electrical connectors, having a first width, when the prongs are in the retracted position or to enable transitioning the prongs to or from the retracted position; and wherein the first portion of the channel is sufficiently narrow to prevent a human finger from reaching one of the first set of electrical connectors when the prongs are extended and sufficiently engaged with the power outlet to obtain power therefrom.

2. The power adapter of claim 1, further comprising:

a prong base, wherein the prongs via attachment to the prong base are pivotably attached to the power adapter;

wherein the channel comprises the first portion to narrowly accommodate the first set of electrical connectors, having a first width, when the prongs are in the retracted position or to enable transitioning the prongs to or from the retracted position;

wherein the channel comprises a second portion to narrowly accommodate the prong base having a second width wider than the first width.

3. The power adapter of claim 2, wherein the first portion of the channel is substantially 6.6 millimeters.

4. The power adapter of claim 2, wherein the second portion of the channel is substantially 9 millimeters.

5. The power adapter of claim 1, further comprising, power conversion circuitry to cause alternating current received by the prongs when engaged with the power outlet, to be provided as direct current to the second set of electrical connectors.

6. The power adapter of claim 1, further comprising, power conversion circuitry to cause a first voltage received by the prongs when engaged with the power outlet, to be provided as a second voltage to the second set of electrical connectors.

7. The power adapter of claim 1, wherein the second set of electrical connectors configured to engage the device and provide electrical power thereto, comprise a removable socket to engage a power cord attachable to the device.

8. The power adapter of claim 1, wherein the second set of electrical connectors configured to engage the device and provide electrical power thereto, comprise contact pads within the power adapter to accommodate a rechargeable battery for charging.

9. An electronic device, comprising:

prongs comprising a set of electrical connectors pivotably attached to the electronic device;

wherein the prongs may be pivoted to a retracted position thereby placing the prong substantially within the electronic device; and wherein the prongs may be pivoted to an extended position thereby placing the prongs substantially perpendicular to a facet of the electronic device and thereby place the electronic device into a configuration wherein the prongs are extended to engage a power outlet and obtain electrical power therefrom;

a channel comprising a first portion to narrowly accommodate the set of electrical connectors, having a first width, when the prongs are in the retracted position or to enable transitioning the prongs to or from the retracted position; and wherein the first portion of the channel is sufficiently narrow to prevent a human finger from reaching one of the set of electrical connectors when the prongs are extended and sufficiently engaged with the power outlet to obtain power therefrom.

10. The electronic device of claim 9, further comprising:

a prong base, wherein the prongs via attachment to the prong base, are pivotably attached to the electronic device; and wherein the channel comprises a second portion to narrowly accommodate the prong base having a second width wider than the first width.

11. The electronic device of claim 10, wherein the first portion of the channel is substantially 6.6 millimeters.

12. The electronic device of claim 10, wherein the second portion of the channel is substantially 9 millimeters.

13. The electronic device of claim 9, further comprising, power conversion circuitry to cause alternating current received by the prongs when engaged with the power outlet, to be provided to the electronic device as direct current.

14. The electronic device of claim 9, further comprising, power conversion circuitry to cause a first voltage received by the prongs when engaged with the power outlet, to be provided as a second voltage to the electronic device.

15. The electronic device of claim 9, further comprising:

a spring applying a force to the prongs when in a first position comprising one of the retracted position or the extended position; and a latch to selectively retain the prongs in the first position or, when released, allow the spring to apply the force to the prongs to cause the prongs in to move to a second position comprising the other of the retracted position or the extended position.

16. The electronic device of claim 9, wherein the electronic device comprises a second set of electrical connectors configured to engage a power cord attachable to another device to apply power thereto.

17. A power conversion device, comprising:

a prong base, comprising prongs, wherein the prongs comprise a first set of electrical connectors and the prong base being pivotably attached to the power conversion device;

a channel in a facet of the power conversion device; and a second set of electrical connectors configured to engage a device and provide electrical power thereto; and wherein the prongs may be pivoted to a retracted position thereby placing the prongs substantially within the power conversion device; and wherein the prongs may be pivoted to an extended position thereby placing the prongs substantially perpendicular to a facet of the power conversion device and thereby place the power conversion device into a configuration wherein the prongs are extended to engage a power outlet and obtain electrical power therefrom;

wherein the channel comprises a first portion to narrowly accommodate the first set of electrical connectors, having a first width, when the prongs are in the retracted position or to enable transitioning the prongs to or from the retracted position and wherein the first portion of the channel is sufficiently narrow to prevent a human finger from reaching one of the first set of electrical connectors when the prongs are extended and sufficiently engaged with the power outlet to obtain power therefrom; and wherein the channel comprises a second portion to narrowly accommodate the prong base having a second width wider than the first width.

* * * * *